United States Patent [19]

Shastal

[11] Patent Number: 4,775,065

[45] Date of Patent: Oct. 4, 1988

[54] TAMPER-RESISTANT DISPENSING CLOSURE

[76] Inventor: Eugene D. Shastal, 1149 S.E. Coral Reef St., Port St. Lucie, Fla. 33452

[21] Appl. No.: 25,220

[22] Filed: Mar. 12, 1987

Related U.S. Application Data

[63] Continuation-in-part of Ser. No. 927,678, Nov. 6, 1986, Pat. No. 4,736,858.

[51] Int. Cl.[4] ..... B65D 43/24

[52] U.S. Cl. ..... 215/235; 215/250; 220/269; 220/335; 220/339; 220/498; 220/517

[58] Field of Search ..... 215/235, 250; 220/266, 220/268, 269, 270, 254, 272, 273, 281, 283, 335, 339

[56] References Cited

U.S. PATENT DOCUMENTS

| | | | |
|---|---|---|---|
| 3,217,949 | 11/1965 | Davis | 220/254 X |
| 3,621,115 | 11/1971 | Kolster | 220/339 X |
| 3,877,598 | 4/1975 | Hazard | 215/250 |
| 3,883,034 | 5/1975 | Rausing | 220/268 |
| 3,999,678 | 12/1976 | Ignell et al. | 220/269 |
| 4,291,818 | 9/1981 | Nozawa et al. | 220/335 |
| 4,361,244 | 11/1982 | Walter | 220/269 |
| 4,391,385 | 7/1983 | Rausing | 220/269 |
| 4,446,984 | 5/1984 | Roth et al. | 220/268 |
| 4,516,689 | 5/1985 | Barker | 220/269 |
| 4,658,980 | 4/1987 | Lindstrom | 220/254 X |
| 4,669,640 | 6/1987 | Ando et al. | 220/269 |
| 4,687,116 | 8/1987 | Dutt et al. | 220/269 |
| 4,700,858 | 10/1987 | Bennett | 220/335 X |

*Primary Examiner*—Stephen Marcus
*Assistant Examiner*—Nova Stucker
*Attorney, Agent, or Firm*—Wood, Dalton, Phillips, Mason & Rowe

[57] ABSTRACT

Closure for selectively closing an opening in a wall, including a base element arranged to be affixed to the wall adjacent the opening therein. In one form, the closure includes an insert having a through opening and defining a recess adjacent the through opening. The insert is urged sealingly against the wall about the wall opening thereof, with the through opening of the insert being aligned with the wall opening. A control element is provided having a connecting portion swingably mounting the control element to the base element, a stopper portion adapted to be received in the insert opening when the control element is pivoted to a first, closed position, and a presser portion adapted to be engaged by a user's fingertip to pivot the control element to withdraw the stopper portion from the insert opening and dispose the presser portion within the recess in a second, open position of the control element. In a second form, the closure includes a base element adapted to be associated with a wall having an opening. A control element has a connecting portion swingably mounted to the base element, a stopper portion having a stopper adapted to be received in the wall opening when the control element is disposed in a first position, and a manipulating portion adapted to be engaged by a user's fingers to swing the control element to withdraw the stopper from the wall opening. The control element is integrally connected to the base element by a readily observable frangible connector, permitting withdrawal of the stopper from the opening only in the event the connecting structure is broken.

39 Claims, 2 Drawing Sheets

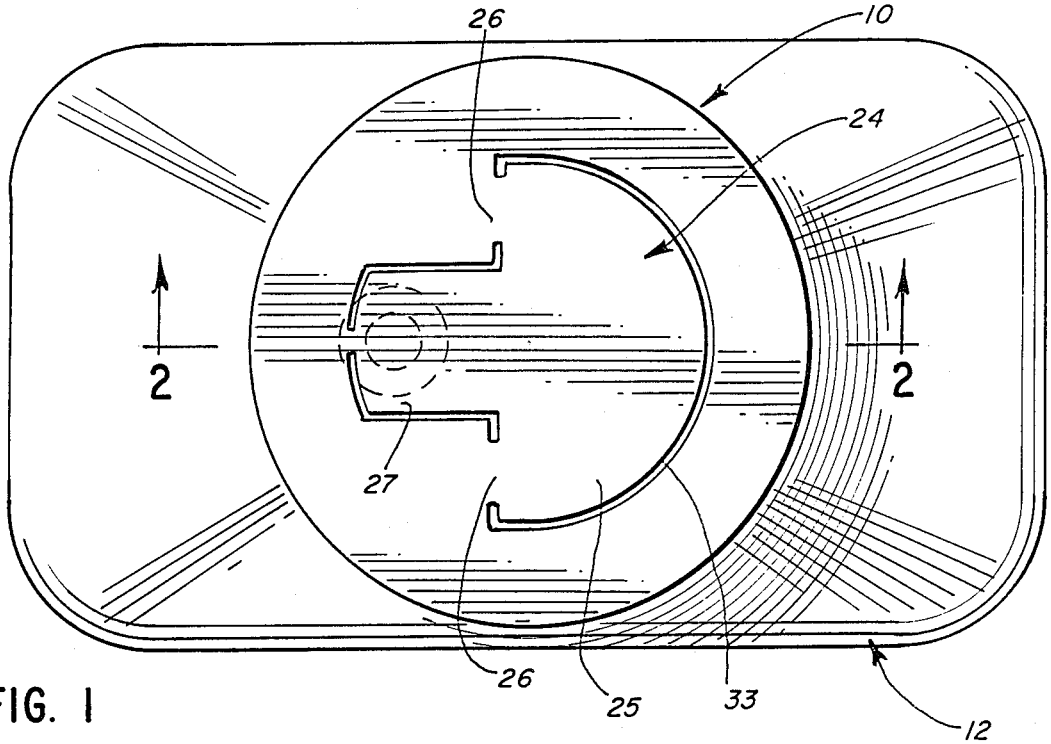
FIG. 1
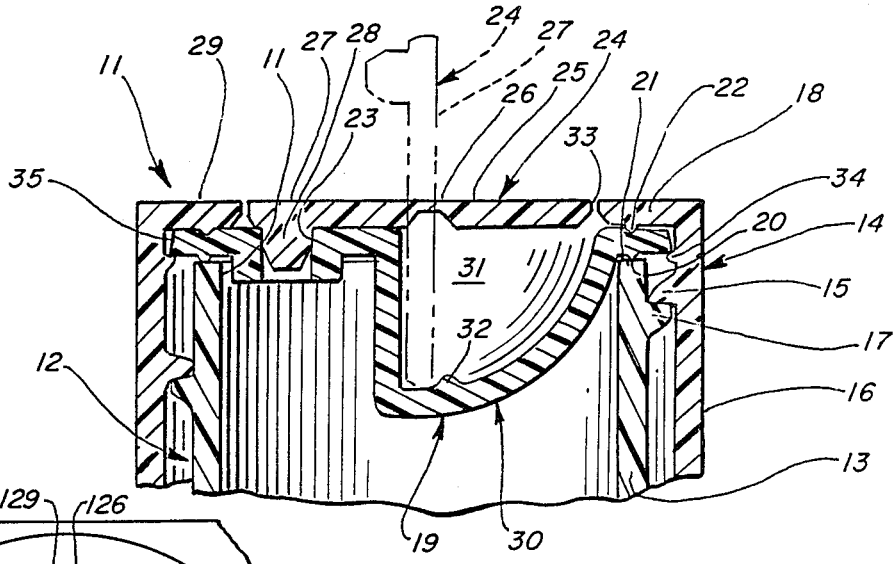
FIG. 2
FIG. 3
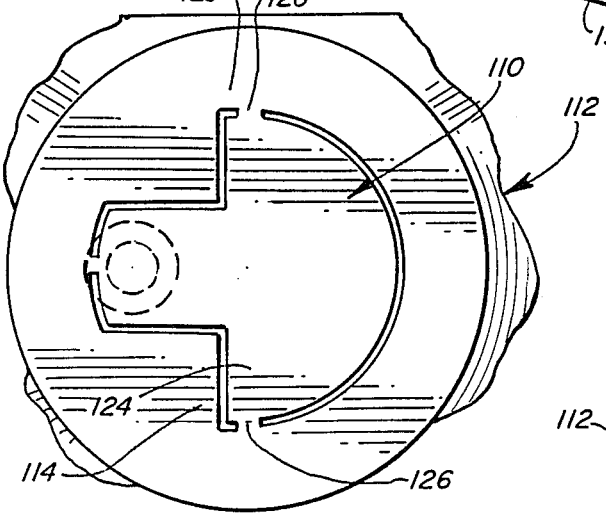
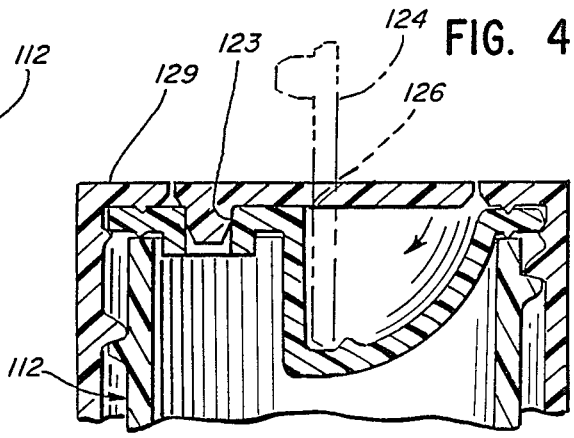
FIG. 4

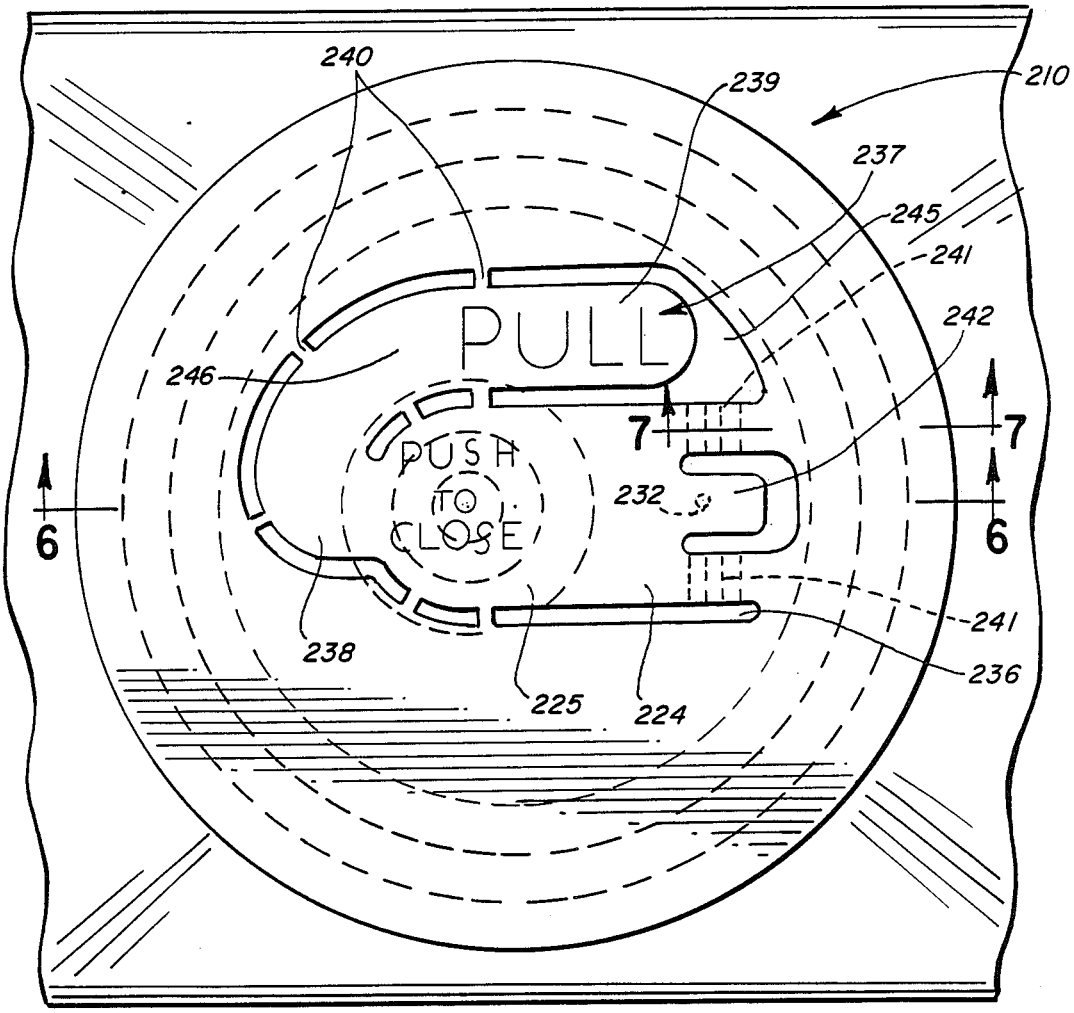
FIG. 5
FIG. 7
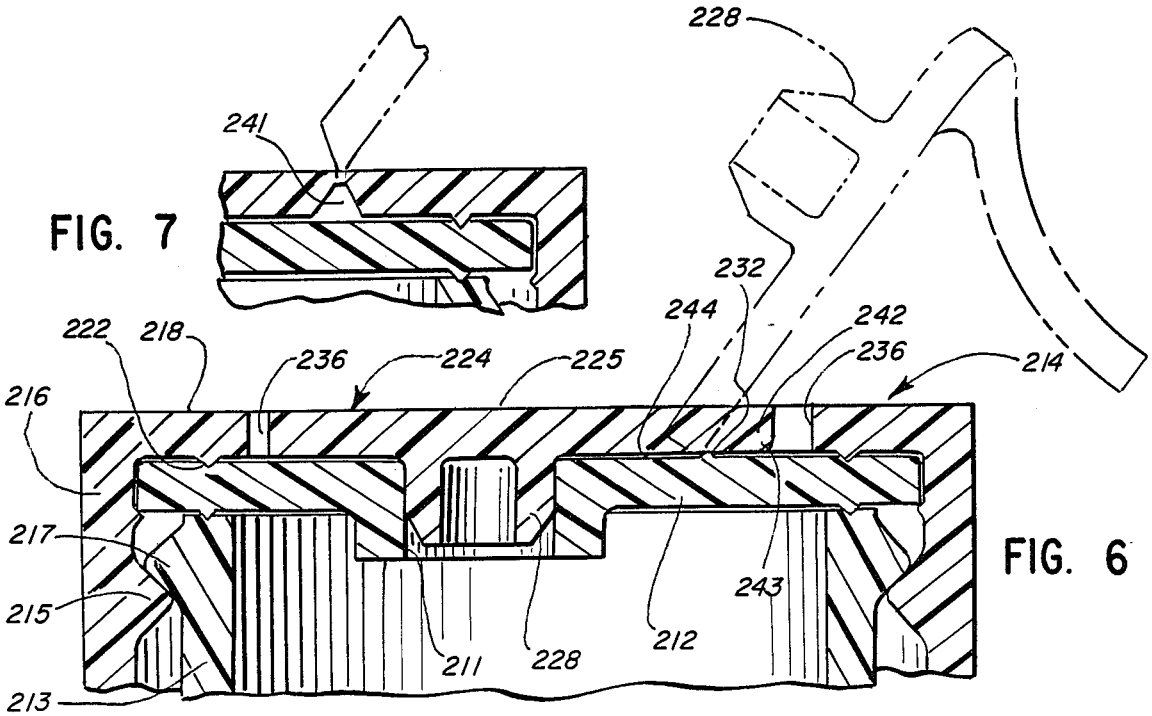
FIG. 6

TAMPER-RESISTANT DISPENSING CLOSURE

CROSS-REFERENCE TO RELATED APPLICATION

This application comprises a continuation-in-part of my copending application Ser. No. 927,678, filed Nov. 6, 1986, entitled "Selectively Closable Container Closure" now U.S. Pat. No. 4,736,858.

TECHNICAL FIELD

This invention relates to container closures and in particular to closures having movable means for selectively closing and opening of a container on which a closure is mounted.

BACKGROUND ART

In one conventional form of closure for controlling delivery of material from a container, the closure is mounted in an opening in an upper wall of the container. The closure defines one or more openings which are selectively closed by an overlying flap. The flap is hingedly mounted to the body of the closure and includes a projecting grasping portion which is exposed when the flap is in the closed position to permit the user to grasp the grasping portion and swing the closure to an upwardly directed position wherein the openings of the closure are exposed to permit passing of material through the container opening and closure opening, such as in dispensing the material from the container.

A serious disadvantage arises in such structure in that the flap tends to remain in somewhat overlying relationship to the openings of the closure so as to inhibit the free flow of material therethrough.

DISCLOSURE OF INVENTION

The present invention comprehends an improved closure for selectively closing and opening of a container wherein means are provided for maintaining a control element portion of the closure in a fully opened position against biasing action tending to urge the control element toward the closed position.

More specifically, the inventnion comprehends the provision of such a closure including a base element having means for affixation thereof to a container adjacent an opening in the container, an insert having a through opening and defin ing a recess adjacent the opening, means on the base element for urging the insert sealingly against the container about the opening and with the through opening aligned with the container opening, and a control element having a connecting portion swingably mounted on one of the base element and insert at the recess, a stopper portion adapted to be received in the insert opening when the control element is swung to a first position, and a pressor portion adapted to be engaged by a user's fingertip to pivot the control element to withdraw the stopper portion from the insert opening and dispose the presser portion within the recess in a second position of the control element.

In the illustrated embodiment, the container comprises a bottle and the closure is adapted to fit over the neck of the bottle, with the opening of the insert aligned with the distal end of the bottle neck.

The means for retaining the control element releasably in the open position comprises a projecting on the portion of the insert defining the recess in the illustrated embodiment.

The control element, in the illustrated embodiment, is integrally hingedly connected to the base member for selective pivotable positioning in the closed first position and open second position.

In the illustrated embodiment, the presser portion of the control element is semicircular and the stopper portion comprises a tongue having a plug element depending from the distal end thereof.

The elements of the closure may be formed of resiliently deflectible material so as to permit facilitated selective positioning and retention of the control element.

In the illustrated embodiment, the base element comprises a cup-shaped element fitted over the distal end of the neck of a bottle container and retaining the insert in sealed association with the end of the neck.

The recess portion of the insert extends into the open end of the bottle neck, whereby the transverse end of the base member extends generally across the open end of the bottle neck.

In the illustrated embodiment, the control element comprises an integral portion of the base element end wall.

Where the bottle neck is provided with a radially outer screw thread, the base element may be provided with a corresponding inwardly directed thread element.

In a modified form, the tamper-resistant closure is adapted for closing an opening in a wall. A base element is adapted to be mounted to the wall in a preselected position. A control element has a connecting portion swingably mounted to the base element, a stopper portion having a stopper adapted to be received in the wall opening, and a manipulating portion adapted to be engaged by a user's fingers to swing the control element to withdraw the stopper from the opening when desired.

The control element is integrally connected to the base element by a readily observable frangible connector, permitting withdrawal of the stopper from the opening only in the event the connector is observably broken.

The control element defines an outer surface disposed substantially flush with the base element outer surface when the control element is dispsoed in the closed position.

The closure further includes an overcenter retaining means for releasably retaining the stopper spaced from the wall opening as a result of swinging of the control element about the connector to a preselected open position.

In the illustrated embodiment, the connecting portion urges the control element to the closed position wherein the stopper is received in the wall opening.

In the illustrated embodiment, the stopper portion is defined by a continuous slit having spaced bridges extending thereacross. The stopper is removable from the opening only in the event the bridges are broken.

The overcenter retaining means effectively comprises releasable locking means movable with the closure portion of the wall element for slidably engaging the wall means to retain the closure portion releasably in an open disposition with the stopper spaced from the wall means opening.

The closures of the present invention are extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a top plan view of a closure embodying a preferred form of the invention mounted on a bottle container;

FIG. 2 is a fragmentary vertical section thereof taken substantially along the line 2—2 of FIG. 1;

FIG. 3 is a fragmentary top plan view of a modified form of closure embodying the invention;

FIG. 4 is a fragmentary vertical section of the embodiment of FIG. 3;

FIG. 5 is a fragmentary top plan view of another modified form of closure embodying the invention mounted on a wall having an opening therein;

FIG. 6 is a fragmentary vertical section taken substantially along the line 6—6 of FIG. 5; and FIG. 7 is a fragmentary vertical section taken substantially along the line 7—7 of FIG. 5.

BEST MODE FOR CARRYING OUT THE INVENTION

In the illustrative embodiment of the invention as disclosed in FIGS. 1 and 2 of the drawing, a closure generally designated 10 is shown for selectively closing an opening 11 in a container generally designated 12. In the illustrated embodiment, opening 11 defines the outer distal end of a neck 13 of a bottle container 12. As will be obvious to those skilled in the art, the invention concept is adapted for use for different forms of containers within the broad scope of the invention.

Closure 10 includes a base element generally designated 14 having means for affixation thereof to the container. In the illustrated embodiment, the affixation means comprises an internal thread 15 on a tubular portion 16 of the closure. Thread 15 cooperates with an outer thread 17 on the bottle neck to secure the base element to the bottle neck, as seen in FIG. 2 of the drawing.

The base element further includes a transversely extending end wall 18 extending across the distal end of the bottle neck when the closure is installed on the neck, as seen in FIG. 2. An insert generally designated 19 is disposed inwardly of base element end wall 18 and includes an annular sealing portion 20 urged sealingly against the distal end 21 of the bottle neck by the end wall 18 of the base element. End wall 18 may be provided with an annular inwardly directed rib 22 aligned with the seal rib 20 to provide sealing force directed through the body of the insert to the sealing rib from the base element.

Insert 19 further defines a through opening 23 communicating with the opening 11 of the bottle neck. The midportion of base element end wall 18 defines a control element 24 including a semicircular presser portion 25, a pair of pivot portions 26, and a stopper portion 27. The stopper portion is provided with a depending plug 28 received in the insert opening 23 when the control element is in a first, closed position, as shown in full lines in FIG. 1.

Pivot portions 26 comprise aligned integral hinge connectins at opposite sides of the stopper portion of the base element. Such hinge connections are commonly referred to as living hinges and tend to urge the control element toward the closed position as a result of the resiliency of the material. In the illustrated embodiment, the base element and insert are illustratively formed of resiliently deflectible synthetic resin, such as polyethylene, polypro pylene, etc.

The invention comprehends the further provision in insert 19 of a recess portion generally designated 30 projecting into the open end of the bottle neck 13, as seen in FIG. 2. The recess portion defines a well 31 adapted to receive the presser portion 25 of the control element when the presser portion is depressed by the user's finger to withdraw the plug 28 from opening 23 and swing the control element 24 to a second, open position, as shown in broken lines in FIG. 2. The invention further comprehends the provision of means for releasably retaining the control element in the open position, whereby material may be delivered through the opening 23 free of impediment by the control element.

More specifically, as seen in FIG. 2, the recess portion 30 of the insert is provided with an upstanding stop projection 32 cooperating with the peripheral edge portion 33 of the control element presser portion 25 to retain the control element in the upright open position of FIG. 2 against the biasing action of the hinge portions 26. The projection 32 and edge portion 33 define resiliently yieldable cooperating portions of the base element and insert, permitting the controlled movement of the edge portion 33 past the projection 32 in moving to and from the open position of the control element.

To restore the control element to the closed position of FIG. 2, the user need merely press his finger against the stopper portion 27, the deflectibility of the base member and insert permitting the movement of edge portion 33 outwardly past the projection 32 in restoring the plug 28 into closing relationship with opening 23.

It should be noted that hinge 26 tends to maintain the plug 28 in the opening 23 to further effect the desired closure of the opening when the control element is in the closed position of FIG. 2.

The stiffness of the resiliently deflectible control element permits the plug 28 to have a friction fit with the insert in the opening 23 to further enhance the closure of the opening in the closed disposition of the control element.

The control element may be integrally formed with the remainder of the base element, whereby the closure comprises a two-piece structure which may be economically formed by molding from suitable synthetic resins. As shown in FIG. 2, the sidewall 16 of the base element may be provided with an annular inturned flange 34 adapted to receive the peripheral edge portion 35 of the insert and thereby maintain the insert in association with the base element as during installation of the closure on the bottle neck.

In one modified form of the invention as disclosed in FIGS. 3 and 4 of the drawing, a closure generally designated 110 is shown to comprise a closure generally similar to closure 10, but having a modified form of connecting means for swingably connecting the control element 124 to the base element 114.

More specifically, as shown in FIG. 3, the control element is connected to the base element by a pivot connection 126 defined by integral pivot connections between the control element and the surrounding edge portion 129 of the base element.

Thus, as seen in FIG. 4, the connection 126 comprises a twistable connection permitting selective disposition of the control element in the closed position shown in full lines in FIG. 4, and the open position shown in broken lines in FIG. 4. Similarly as described relative to closure 10, closure 110 is arranged to effectively retain the control element in the open position when desired.

In all other respects, closure 110 is similar to and functions in a manner similar to the functioning of closure 10. Elements of closure 110 which are similar to corresponding elements of closure 10 are identified by the same reference numerals but 100 higher.

Referring now to the embodiment of FIGS. 5–7, another form of modified closure embodying the invention generally designated 210 is shown to comprise structure for selectively closing an opening 211 in a wall 212.

Closure 210 includes a base element 214 having means for affixation thereof to a container or the like, such as a bottle-type container defining a neck 213. The means for securing the base element to the bottle neck illustratively comprises an internal thread 215 on a depending tubular portion 216 of the base element, which cooperates with an outwardly projecting thread 217 on the bottleneck.

As shown in FIG. 6, the base element 214 may embrace the wall element 212 so as to maintain the wall element in sealed association with the bottle neck 213, with the opening 211 of the wall element opening to the interior of the bottle neck. As will be obvious to those skilled in the art, the wall element 212 may take the form of any desired wall element having an opening therein intended to be releasably closed by a closure associated therewith.

As further shown in the drawing, base element 214 includes a transversely extending end wall 218 provided with an inwardly directed annular rib 222 sealingly engaging the wall 212.

The midportion of base element 214 defines a control element 224 having a presser portion 225 overlying a depending plug 228 adapted to be sealingly received in the wall opening 211 in a first, closed position, of the closure, as shown in full lines in FIG. 6.

The control element is formed integrally with the base element and is defined by a plurality of slits 236. Outwardly of the presser portion 225, the control element is provided with a tab portion 237 having a connecting portion 238 and a fingertip pull portion 239. Tab portion 237 is formed directly in the wall of the base element by the slits 236 and, thus, lies flush with the base element in the original arrangement thereof in the forming of the closure 210. As best seen in FIG. 5, the slits 236 are discontinuous, being separated at spaced positions by bridges 240 extending between the control element and the remainder of the base element. Bridges 240 are readily observable by the user of the closure. As the bridges maintain the tab portion 237 flush with the wall until such time as the birdges are broken, the bridges serve as an indicator as to whether the closure has been opened in the past, i.e. the plug 228 has been removed upwardly from the wall opening 211. The arrangement of the closure structure is such that plug 228 cannot be removed sufficiently from the opening 211 to permit entrance to the container in the absence of breaking of bridges 240, thereby causing the closure to be a tamper-resistant closure.

Control element 224 is pivotally connected to the base element by a pair of living hinges 241 generally similar to the pivot portions 26 of closure 10. As seen in FIG. 5, the living hinges are disposed at opposite sides of a locking tongue 242 defining a distal tail portion of the control element at the end opposite the end to which the tab portion 237 is joined. The inner distal surface 243 of the locking tongue is rounded, as illustrated in FIG. 6, to facilitate the sliding movement thereof along the upper surface 244 of the wall element 212, as the control element is pivoted on the living hinges 241, to an overcenter position wherein the end surface 243 moves from rearwardly of the pivot means to forwardly thereof, as illustrated in broken lines in FIG. 6.

In the illustrated embodiment, wall element 212 is provided with a detent 232 releasably retaining the locking tongue 242 in the overcentered disposition, wherein the plug 228 is spaced from the wall opening 211 with the control element in an open position of the closure. In this arrangement, contents of the bottle may be delivered through neck 213 in the now open opening 211, as desired.

The closure is brought to the open position from the closed position of FIG. 5 by the user firstly separating the tab portion 237 from the base element by an upward pull on the tab element by the user's fingers. Slits 236 define an opening 245 at the distal end of tab portion 237, permitting the user to grasp the distal end of the tab portion and pull it upwardly breaking the bridges 240 along the tab portion and about the presser portion 225. Further upward pulling on the tab portion may now be effected to withdraw the plug 228 from opening 211 and permitting swinging of the control element about the hinges 241 to the open position illustrated in dotted lines in FIG. 6. As discussed above, the breaking of bridges 240 is readily discernible to the user and, thus, serves as an indicium of a prior opening of the closure.

The closure may be readily returned to the closed position, shown in full lines in FIG. 7, by urging the control element in a clockwise direction about the hinge 241, returning the control element from the dotted line open position to the full line closed position wherein the control element is once again flush with the base element 214. In the closed position, the tab portion 237 will tend to remain spaced from the original side-by-side relationship flush with the base element and thus serves as a further indication that the device has been previously opened.

The location of the locking tongue surface 243 relative to the hinges 241 is preselected to provide a positive releasable locked arrangement of the control element in the open position of the closure so as to permit facilitated pouring of the contents of the bottle therefrom without interference by the control element, notwithstanding the normal biasing of the control element by the resilient living hinges back to the closed position.

The tab portion 237 may be provided with suitable serrations 246, if desired, to facilitate manipulation of the control element.

Closure 210 may be utilized in extremely small structures, such as closures having a diameter as small as approximately 20 mm. In the illustrated embodiment, the wall opening 211 is illustrated as having a diameter of approximately 0.150", it being understood that this size opening is illustrative only. In the illustrated embodiment, the tab portion has a length of approximately ½". Any suitable number of bridges 240 may be employed as desired within the broad scope of the invention.

Plug 228 preferably has a friction fit with the wall element 212 in opening 211 and may be utilized to effect a sealing cloure of the container as desired.

The foregoing disclosure of specific embodiments is illustrative of the broad inventive concepts comprehended by the invention.

I claim:

1. A closure for selectively closing an opening of a container, said closure comprising:

a base element having means for affixation thereof to a container adjacent an opening in the container;

an insert having a through opening and means defining a recess adjacent said insert opening;

means on said base element for securing said insert sealingly against the container about the container opening and with said through opening aligned with said container opening;

a control element formed unitarily integrally with said base element and having a connecting portion swingably joined to said base element, a stopper portion adapted to be received in said insert through opening when the control element is in a first position, and manipulating means comprising an integral portion of the control element adapted to be manually engaged by a user for swinging the control element to withdraw the stopper portion from said insert opening and dispose a portion of the control element within said recess in a second position of the control element; and a frangible bridge connected between said control element and said base element disposed to be observable by the user when attempting to swing the control element from said first position to said open position.

2. The closure structure of claim 1 wherein said base element defines an outer surface and said control element defines an outer surface disposed substantially flush with said base element outer surface when the control element is disposed in said first position.

3. The closure structure of claim 1 wherein said base element defines an outer surface and said control element defines an outer surface disposed substantially flush with said base element outer surface when the control element is disposed in said first position, said control element outer surface extending substatially perpendicularly to said base element outer surface in said second position with the portion of the control element defining the connection of the bridge thereto being disposed outermost.

4. The closure structure of claim 1 wherein said base element and bridge are defines a through opening and said control element received fully within said opening in said first position.

5. The closure structure of claim 1 wherein said bridge is disposed adjacent said stopper portion of the control element.

6. The closure structure of claim 1 wherein said bridge is formed of synthetic resin.

7. The closure structure of claim 1 wherein said manipulating means of the control element defines a distal semicircular edge.

8. The closure structure of claim 1 wherein said stopper portion of the control element comprises a tapered plug element.

9. The closure structure of claim 1 wherein said connecting portion pivotally connects the control element to said base element.

10. The closure structure of claim 1 wherein said connecting portion hingedly connects the control element to said base element.

11. The closure structure of claim 1 further including cooperating retaining means on said insert and said control element for releasably retaining said control element in said second position, said means defining the means comprising said retaining means on said insert.

12. The closure structure of claim 11 wherein said retaining means comprises a projection on said insert and an edge portion of said control element.

13. The closure structure of claim 11 wherein said retaining means comprises a projection on said insert in said recess and an edge portion of said control element spaced remotely from said frangible bridge.

14. The closure structure of claim 1 wherein said presser portion of the control element defines a distal edge portion and a projection on said insert releasably engaged by said distal edge portion.

15. The closure structure of claim 11 wherein said retaining means comprises a projection on said insert in said recess and an edge portion of said control element, said projection being disposed to retain said control element, said projection being disposed to retain said control element in said second position with the portion of the control element defining the connection of the bridge thereto being disposed for observation by the user.

16. The closure structure of claim 1 wherein said unilaterally integral control element and base element are formed of resiliently deflectible material.

17. The closure structure of claim 1 wherein said connecting portion of the control element comprises an integral, twistable connection between said control element and said base element.

18. The closure structure of claim 1 wherein said insert and control element are formed of similar synthetic resin.

19. The closure structure of claim 1 adapted for selectively closing the neck of a bottle, said base element comprising a cup-shaped base element having a tubular sidewall, and end wall, and means on said sidewall for affixation of the base element to the neck of a bottle with said end wall extending across the open end of the bottle neck, said means on said base element for urging said insert comprising means for urging said insert sealingly against the distal end of the bottle neck about the end opening of the neck and with said through opening aligned with said bottle neck end opening, and said connecting portion comprising a hinge portion hingedly mounted to said base element at said recess.

20. The closure structure of claim 19 wherein said recess is disposed above said insert.

21. The closure structure of claim 19 wherein said control element comprises an integral portion of said base element end wall.

22. The closure structure of claim 1 wherein said base element defines a planar top surface and said manipulating portion includes a portion connected to said stopper portion and having a top surface flush with said wall element top surface.

23. A tamper-resistant closure for selectively closing an opening in a wall, said wall defining an upper surface, said closure comprising:

a base element having means for retained association thereof with said wall in a preselected position;

detent means projecting upwardly from said wall upper surface; and a control element having a connecting portion swingably mounted to said base element, a stopper portion having a stopper adapted to be received in said wall opening when the control element is disposed in a first, closed position with said base element disposed in said preselected position, a manipulating portion extending outwardly from a limited portion of the stopper portion oppositely of said connecting portion and being adapted to be engaged by a user's fingers to act as a second class lever to withdraw said stopper from said opening, said control element being integrally connected to the base element by readily observable frangible connecting means permitting withdrawal of the stopper from the opening only in the event said connecting means are broken, and defelectible retaining means on said control element deflected by said detent means as a result of the control element being moved from said closed position to an open position and retained against said detent means in an overcenter disposition for releasably retaining said control element in said open position.

24. The closure structure of claim 23 wherein said base element defines an outer surface and said control element defines an outer surface disposed substantially flush with said base element outer surface when the control element is disposed in said first position.

25. The closure structure of claim 23 wherein said connecting portion comprises means for urging the control element to a closed position whenever said stopper is received in the wall opening.

26. The closure structure of claim 25 wherein said base element defines an outer surface and said control element defines an outer surface disposed substantially flush with said base element outer surface when the control element is disposed in said first position, said control element outer surface extending toward said base element outer surface in said second position.

27. The closure structure of claim 23 wherein said base element defines a through opening and said control element is received within said opening in said first position.

28. The closure structure of claim 23 wherein said control element defines an end portion and said connecting portion is dispsed at said end portion.

29. The closure structure of claim 23 wherein said manipulating portion of the control element is elongate.

30. The closure structure of claim 23 wherein said stopper portion comprises a first end portion of the control element and said stopper comprises a plug element depending from said stopper portion, said control element further defining an opposite, second end portion, said connecting portion being disposed adjacent said second end portion.

31. The closure structure of claim 23 wherein said retaining means comprise a distal end portion of said control element.

32. The closure structure of claim 31 wherein said distal end portion of the control element is formed of resiliently deflectible material.

33. The closure structure of claim 23 wherein said connecting portion of the control element comprises an integral, twistable connection of said control element to said base element.

34. The closure structure of claim 23 wherein said control element is formed of synthetic resin.

35. The closure structure of claim 23 wherein said retaining means comprises a tail on said control element for selectively engaging said shoulder means for releasably retaining said control element in an open position.

36. The closure structure of claim 23 wherein said control element is disposed flush in said base element, said manipulating portion defines a distal end, and said base element defines an opening at said distal end to permit the user to insert the user's fingertip into said opening and urge said distal end outwardly from said flush disposition with said base element.

37. The closure structure of claim 23 wherein said retaining means comprises a distal end portion of said control element, said control element is disposed flush in said base element, and said base element defines an opening providing a space surrounding said retaining means.

38. The closure structure of claim 23 wherein said connecting portion is provided with a recess widening toward said wall element.

39. For use with wall means for defining an opening to be selectively closed, a one-piece tamper-resistant closure comprising:

means on said wall means defining an upstanding detent;

a wall element;

means for retaining said wall element in overlying relationship to said wall means opening, said wall element having a stopper portion provided with a stopper removably received in and stopping said wall means opening, said stopper portion being defined by a continuous slit having spaced bridges extending thereacross, said stopper being removable from said opening only in the event said bridges are broken, said wall element further defining a fingertip grasping portion defining means for urging said stopper portion away from said wall means with concurrent breaking of said bridges and removal of said stopper from the opening of said wall element, the broken condition of said bridges comprising an indication that access to said opening has been had;

connecting means for pivotally connecting said stopper portion in the wall element, said connecting means being disposed to cooperate with said stopper portion and said means for urging the stopper portion away from the wall means to define a second class lever; and deflectible locking means on said wall element adjacent said connecting means and being movable with said stopper portion of the wall element for slidably engaging and being deflected by said detent as a result of said wall element being moved from a closed position wherein said stopper portion is received in said wall means opening to an open position whenever said stopper portion is spaced from said wall means opening and defining with said detent an overcenter lock with said locking means being retained in engagement with said detent in said open position for releasably retaining said closure portion in said open disposition.

* * * * *